United States Patent [19]

Vial

[11] Patent Number: 4,506,724

[45] Date of Patent: Mar. 26, 1985

[54] INGOT MOLD WITH ADJUSTABLE DIMENSIONS FOR A CONTINUOUS CASTING MACHINE

[75] Inventor: Raymond Vial, Lorette, France

[73] Assignee: Cledid S.A., Saint-Chamond, France

[21] Appl. No.: 243,295

[22] Filed: Mar. 13, 1981

[30] Foreign Application Priority Data

Mar. 19, 1980 [FR] France ..... 80 06126

[51] Int. Cl.[3] ..... B22D 11/04; B22D 11/16

[52] U.S. Cl. ..... 164/436; 164/443

[58] Field of Search ..... 164/436, 491, 418, 443

[56] References Cited

U.S. PATENT DOCUMENTS

| | | | |
|---|---|---|---|
| 3,049,769 | 8/1962 | Schultz | 164/436 |
| 3,292,216 | 12/1966 | Colombo | 164/436 X |
| 3,583,473 | 6/1971 | Strohschein et al. | 164/436 |
| 3,760,867 | 9/1973 | Murakami et al. | 164/436 |
| 4,069,863 | 1/1978 | Hargassner et al. | 164/436 |
| 4,085,793 | 4/1978 | Scheinecker et al. | 164/436 |
| 4,147,202 | 4/1979 | Gay | 164/436 |
| 4,171,719 | 10/1979 | Wunnenberg et al. | 164/436 X |

FOREIGN PATENT DOCUMENTS

| | | | |
|---|---|---|---|
| 1323952 | 3/1963 | France | 164/436 |
| 2365389 | 4/1978 | France . | |

*Primary Examiner*—Nicholas P. Godici
*Assistant Examiner*—J. Reed Batten, Jr.
*Attorney, Agent, or Firm*—Pollock, Vande Sande & Priddy

[57] ABSTRACT

An ingot mold with adjustable dimensions for a machine for continuously casting metal, comprising a support frame fixed on the oscillating table of the machine, two transverse walls and two longitudinal walls, connected to the support frame. The transverse walls are fixed to the support frame by application to the interior faces of the corresponding sides, and each transverse wall is provided with individual members for adjusting its thickness in accordance with the desired spacing between them. The support frame can thus be rigidly and permanently fixed on the oscillation table, the dimensions of the casting cavity being determined merely by adjustment of the thickness of the walls.

9 Claims, 6 Drawing Figures

INGOT MOLD WITH ADJUSTABLE DIMENSIONS FOR A CONTINUOUS CASTING MACHINE

The object of the present invention is an ingot mold with adjustable dimensions for a continuous casting machine.

A machine for continuously casting metal, particularly steel, is, in outline, constituted by a bottomless mold termed an ingot mold, followed by a secondary cooling region.

The mold is constituted by a cavity with a section corresponding to that of the product required to be cast, generally with a vertical axis and open at top and bottom. This cavity is bounded by cooled walls, and the steel poured from a casting ladle is superficially cooled so that it forms a bar inside the casting cavity which is bounded by a solidified layer and whose interior remains liquid. At the outlet of the casting mold, this bar moves into the secondary cooling region which can be constituted in various ways, within which the bar is cooled, allowing it to solidify completely. The bar then passes into a withdrawing cage which assures that it moves forward. The cooling region is generally constituted by a guiding roller apron, curved in shape, which assures that the bar moves from a vertical axis to a horizontal axis, simultaneously with the secondary cooling.

To avoid adherence of the solidified layer to the inner faces of the cavity, the ingot mold is usually given a vertical oscillatory movement, being mounted on an oscillation table to achieve this. Also, ingot molds with adjustable dimensions are generally used, so that production is not limited to a bar of single section. In the most common case of casting slabs with rectangular section, the ingot mold is then constituted by four walls, opposed and parallel in pairs, two longitudinal walls, and two transverse walls respectively. These walls, whose inner faces delimit the casting cavity, are mounted inside a support frame which is itself fixed on the oscillation table.

One such ingot mold, termed "with plates", is known from many documents such as French Pat. Nos. 1,388,653, 2,004,197, 2,064,167 and 2,339,455.

The transverse walls, termed interior, in such ingot molds, are generally interposed between the longitudinal walls, termed exterior. Because of this, to alter the width of the slab, the transverse walls need simply to be moved inside the longitudinal walls, and to achieve this, the transverse walls are generally connected to the frame by displacing members such as actuators.

Also, the thickness of the slab is determined by the width of the transverse walls and, consequently, if the thickness of the slab is required to be altered, the transverse walls are usually replaced by other wider or narrower walls. The longitudinal walls are therefore also connected to the support frame by actuators which allow them to be separated to free the transverse walls, or to be applied under pressure against the transverse walls interposed between them so as to assure sealing at the corners and rigidity of the unit formed by the four walls.

The transverse walls are mounted removably on adjusting actuators, so that they can be easily removed. The exterior longitudinal walls, however, are generally not removed easily, although they sometimes have to be replaced. To date, this drawback has not been considered very important, since adjustment of the dimensions of the ingot mold is in any case carried out in the workshop away from the casting installation. In practice, each time the ingot mold has to be replaced to alter its dimensions or because of wear on the walls, the unit constituted by the support frame, the four walls and their actuators as well as the cooling circuits is removed from the oscillation table and replaced by a new ingot mold constituted by another support frame fitted with cooling circuits, actuators and new walls or repaired walls.

The precise arrangement of the support frame on the oscillation table is complicated by the fact that the elements for guiding the support frame with respect to the table are frequently damaged and must be repaired on site. Also, the ingot mold unit formed by the support frame and the four walls is difficult to handle. In addition, as the four walls move with respect to the corresponding side of the support frame and over a distance which can be relatively great in the case of transverse walls, their inner cooling circuits have to be connected, by hoses or at least telescopic couplings, to circuits for supplying and discharging a cooling fluid such as water, provided on the support frame.

The object of the invention is a new arrangement allowing these disadvantages to be avoided.

The basic idea of the invention consists in assuring adjustment of separation and fixing of the transverse walls directly on the support frame and not, as previously, by the single application of longitudinal walls.

To achieve this, in accordance with the invention, the means for fixing the transverse walls are constituted by actuators for applying each wall to the interior face of the corresponding side of the support frame, each wall extending over a thickness equalling the distance between the interior face of the support frame and the inner face of the casting cavity and being provided with means for removable coupling onto the corresponding coupling means urged by the said application actuators outwards from the frame to fix the wall and inwards to free the wall, and the means for adjusting the separation of the inner faces of the transverse walls are constituted by members for individual adjustment of the thickness of each transverse wall.

Thus, as the transverse plates are still supported by the support frame whose interior face serves as reference, adjustment of their separation is carried out simply by acting on the thickness of the plates, not by means of actuators. In addition, fixing of the plates is assured by simple application against the support frame by means of traction actuators; by contrast, in prior art installations, the actuators for adjusting the width of the slab which have to assure movement of the transverse plates over a considerable distance with respect to the support frame do not assure fixing of the transverse plates, this then being obtained by the presence of the longitudinal walls. But this adjustment can therefore only be carried out in the workshop and consequently requires dismantling of the support frame.

Conversely, according to an essential characteristic of the invention, the four walls are removable and the support frame is rigidly and permanently fixed on the oscillation table, the dimensions of the cavity being determined outside the installation by adjustment of the thicknesses of the walls in the workshop.

As the support frame is permanently fixed on the oscillation table, it is possible to make its structure heavier and more rigid and to improve the protection of the circuits for supplying and discharging the cooling fluid, as well as the hydraulic circuits for controlling the actuators for applying the walls.

As in prior art arrangements, the separation of the external longitudinal walls which corresponds to the thickness of the slab is determined by the width of the transverse plates. However, according to an additional characteristic of the invention, each longitudinal wall extends over a thickness between the inner face facing the casting cavity and an outer face facing the interior face of the corresponding side of the support frame and separated from this only by a clearance which is sufficient for positioning the wall. The means for applying the longitudinal walls supported against the support frame and provided with removable members for fixing the walls only act over a distance equalling the said clearance, and each longitudinal wall is provided with members for adjusting its thickness as a function of the thickness of the casting cavity determined by the width of the transverse walls.

Thus, by making the longitudinal walls adjustable in width, like the transverse walls, the travel of the application actuators can be reduced to the single clearance necessary for positioning them, the actuators thus being better protected inside the support frame. In prior art arrangements, the actuators for driving the longitudinal plates have to move over a distance corresponding to the anticipated variations in the thickness of the slab and are therefore more exposed and cannot assure fixing of the longitudinal plates with the same rigidity.

In summary, the new arrangements provided according to the invention allow the following essential advantages to be obtained;

The rigidity of the support frame is increased because it is permanently fixed and connected to the oscillation table.

Supplying the walls with cooling fluid and discharging the said fluid is carried out exclusively through the support frame which is therefore itself considerably cooled.

Adjustment of the dimensions of the casting cavity is carried out outside the casting region on a support frame serving as a jig and of a shape with dimensions identical to those of the support frame permanently fixed on the oscillation table. The walls positioned in the support frame solid with the oscillation table therefore do not need additional adjustment and changing of the casting sections is quicker.

Moving and handling the individual walls is easier than with an ingot mold unit (a unit constituted by walls and their support frame).

Connection of the cooling circuit of each wall to the supply and discharge circuits provided in the support frame occurs automatically when each wall is positioned in the support frame.

Other characteristics and advantages of the invention will appear from the following description of an embodiment of the ingot mold according to the invention, this description being given with reference to the attached drawings in which.

Figure 1:
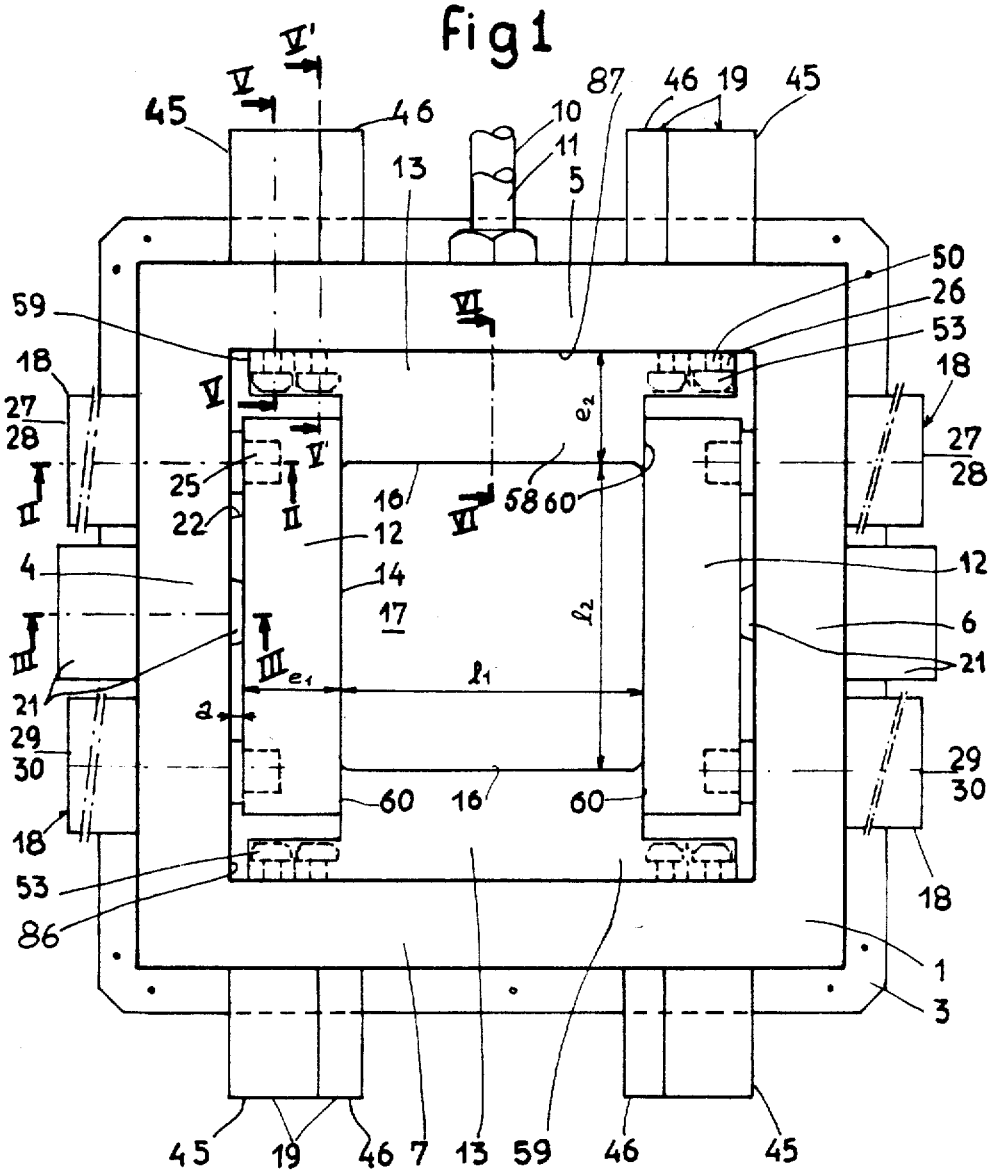
FIG. 1 is a plan view of the ingot mold resting on an oscillation table.

As represented in the drawing, the ingot mold according to the invention comprises a support frame 1 whose horizontal transverse section is rectangular and which is permanently fixed, at its flat base 2, on an oscillation table 3 of known construction. The sides 4, 5, 6, 7 of the support frame 1 are formed by hollow beams or casings of rectangular transverse section whose narrow longitudinal sides constitute the flat base 2 of the support frame 1. Inside the support frame 1, at the lower part, there is provided a supply passage 8 for cooling fluid such as water, and, at the upper part, a discharge passage 9, these two passages 8 and 9 extending into the said support frame 1, each being like a circular chamber and connecting respectively by couplings 10 and 11, one (8) to a source of cooling fluid and the other (9) to the tank. The various hollow beams or casings 4 to 7 are rigidly and sealingly connected together at their contiguous ends and comprising a stiffening inner structure rendering the whole of the support frame 1 rigid.

A pair of walls 12 termed exterior and a pair of walls 13 termed interior are associated with this support frame 1. The exterior walls 12 face each other and grip between them, with the ends of their vertical inner faces 14, one part of the small lateral vertical faces 60 of the two interior walls 13 which also face each other.

The inner faces 14 and 16 of the plates 12 and 13 thus delimit an open casting cavity 17 of rectangular section which determines the section of the bar or billet to be cast.

The ratio of the dimensions $l_1$ and $l_2$ of the cavity 17 depends on the product required to be cast. In the case of a slab of rectangular section, the interior or transverse walls 13 have a width $l_1$ corresponding to the thickness of the slab and they are interposed between the exterior longitudinal walls 12, their separation $l_2$ determining the width of the slab.

Rapid fixing means, respectively 18 and 19, for the walls 12 and 13, are provided on the support frame 1. These rapid fixing means are of different designs depending on whether they are means (18) associated with the exterior walls 12 or means (19) associated with the interior walls 13.

Figure 3:
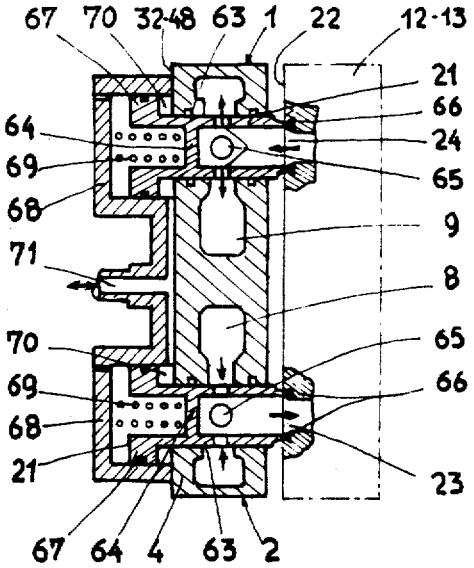
FIG. 3 is a view in elevation of a vertical section through the support frame at the location of the coupling for connecting the supply and discharge conduits of the support frame to the cooling circuit of a longitudinal or transverse wall, along line III—III of FIG. 1.
Figure 6:
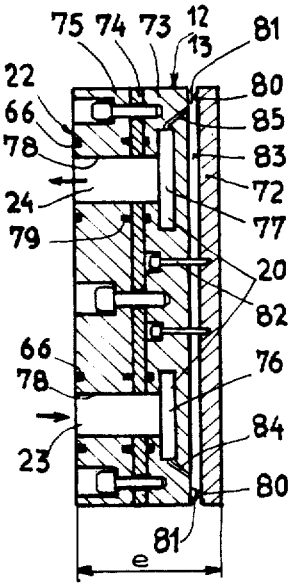
FIG. 6 is a view in elevation of a transverse vertical section through a longitudinal or transverse wall along line VI—VI of FIG. 1.

Each wall 12, 13 includes its own cooling circuit 20 (FIG. 6) whose inlet and outlet are connected to the supply and discharge conduits 8 and 9 of the support frame 1 by rapid sliding couplings 21 (FIG. 3) which without external intervention remain permanently and sealingly applied against the outer face 22 of the plates 12, 13 in a region surrounding the inlet and outlet orifices 23 and 24 of the cooling circuit.

Figure 2:
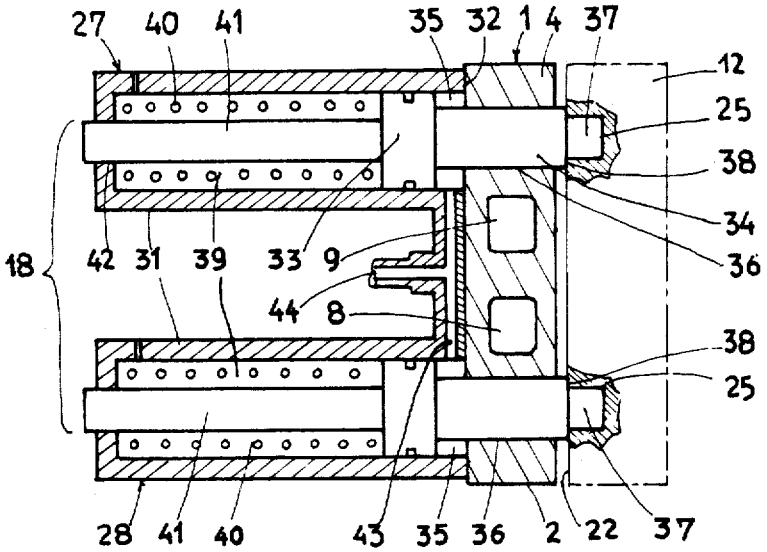
FIG. 2 is a view in elevation of a vertical section through the support frame at the location of the means for rapidly fixing a longitudinal wall, along line II—II of FIG. 1.

In addition, each wall 12, 13 includes its own rapid fixing means 25 (FIG. 2), 26 (FIG. 5) which differ according to whether a longitudinal or transverse wall 12 or 13 is concerned and which cooperate with those (18, 19) provided on the support frame 1.

The rapid fixing means 18 of a longitudinal wall (FIG. 2) comprise at least four horizontal so-called thrust actuators 27, 28, 29, 30 which are superposed in pairs and arranged so that their axes are parallel to the inner faces 16 of the transverse walls 13 and perpendicular to the inner faces 14 of the longitudinal walls 12.

In addition, they are positioned to face the upper and lower parts of one end of an exterior wall 12 and substantially in the extension of the inner part of an interior wall 13.

Each return actuator 27 to 30 includes, on the one hand, a cylinder 31, fixed at one end to the exterior face 32 of the beams 4 and 6 of the support frame 1, the beams 4 and 6 being associated with the exterior walls 12, and, on the other hand, a piston 33 which slides sealingly in the cylinder 31 and is provided with a front rod 34 which passes through a control chamber 35 delimited by the cylinder 31, the piston 33 and the rear face 32 of the beam 4, 6, as well as a guide passage 36 provided in the base 4, 6 of the support frame 1 and corresponding exactly to the shape and periphery of the said front rod 34. The free end of the front rod 34 is provided with a support stud 37 whose lateral face is separated from that of the rod 34 by an annular shoulder 38 which bears against the rear face 22 of the exterior wall 12.

The support stud 37 enters without lateral play into a recess 25 provided in the exterior wall 12 from the exterior face 22 of the latter. This recess 25 together with the other recesses 25 of the exterior wall 12 constitutes the rapid fixing means of the exterior wall 12, these means 25 cooperating with the means 18 provided on the support frame 1.

In the rear chamber 39 delimited by the cylinder 31 and the rear face of the piston 33, a return spring 40 is disposed which bears on the piston 33 and the rear wall of the cylinder 31 and constantly urges the rod 34 and the stud in the direction of the exterior plate 12 and the interior wall 13. If necessary, the rear face of the piston 33 bears a guide rod 41 surrounded by the return spring 40 and guided without play in an opening 42 cut in the rear wall of the cylinder 31.

The control chamber 35 is connected through conduits 43, 44 and a valve (not shown) to a source of gaseous or liquid fluid. When the fluid is let into the chamber 35, the piston 33 moves back, compressing the spring 40, and the support stud 37 retracts into the passage 36, thus allowing positioning from the top of the exterior wall 12 whose recesses 25 are to be aligned with the axes of the rods 34 and will then be able to receive the corresponding support studs 37.

Figure 4:
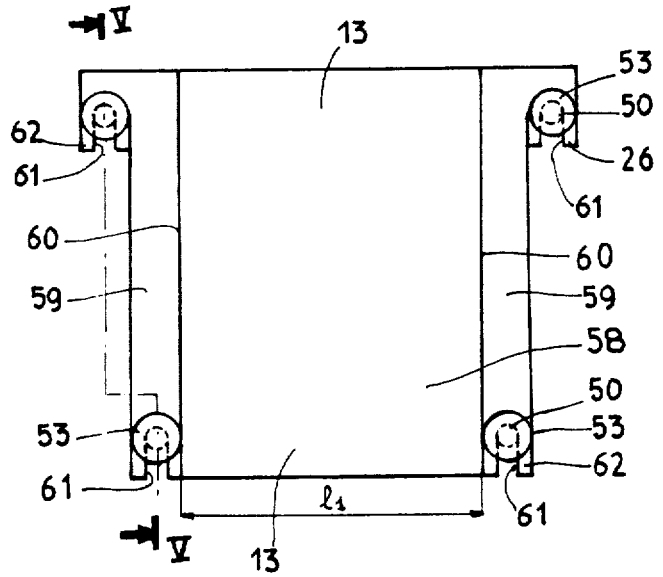
FIG. 4 is a front view in elevation of a transverse wall of the ingot mold.
Figure 5:
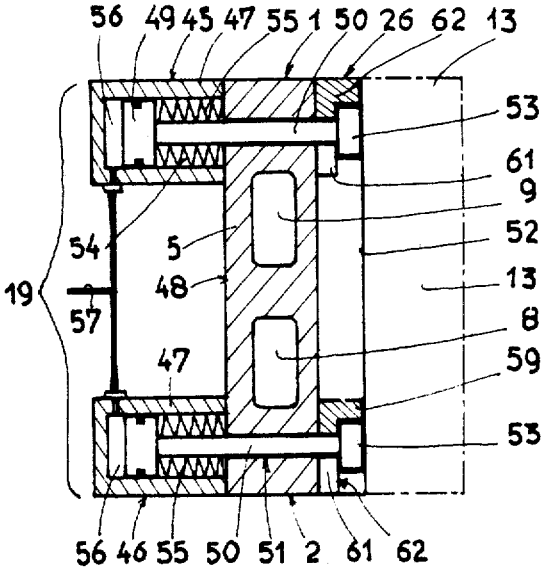
FIG. 5 is a view in elevation of a broken section passing partly through the transverse wall at the location of the means for rapid fixing of the latter, along line V—V of FIG. 4 and lines V—V and V'—V' of FIG. 1.

The rapid fixing means 19 associated with each transverse interior wall 13 are represented in more detail in FIGS. 4 and 5 and include, for each interior wall 13, four horizontal application and locking actuators 45, 46 which are superposed in pairs (for example, 45, 46, FIGS. 1 and 5), the upper actuator 45 of each pair of actuators 45, 46 being offset laterally towards the exterior face 22 of the adjacent longitudinal wall 12 with respect to the lower actuator 46. Each locking actuator 45, 46 includes a cylinder 47 whose front end is fixed sealingly on the rear face 48 of the beams 5 and 7 of the support frame 1, these beams 5 and 7 being associated with the interior walls 13. In this cylinder 47 a piston 49 slides sealingly and bears at its front face a connecting rod 50 passing without play through a guide passage 51 in the beam 5 or 7 of the support frame 1. At its free end located on the inner side 52 of the beam 5 and 7, the connecting rod 50 bears a retaining head 53 of enlarged section extending radially beyond the periphery of the said rod 50. In the chamber 54 delimited by the cylinder 47, the front face of the piston 49 and the rear face 48 of the beam 5 or 7, is provided with a return spring or Belleville washers 55 urging the retaining head 53 backwards, i.e., towards the exterior of the support frame 1. The control chamber 56 located between the bottom of the cylinder 47 and the rear face of the piston 49 is connected via conduits 57 and a valve (not shown) to either a source of pressurized fluid or the tank.

The rapid fixing means 26 of the interior transverse wall 13 are provided outside the active part 58 of the said plate 13. These means 26 are provided in fixing webs 59 provided at the back of the plate 13 and adjacent to the lateral faces 60 of the active part 58 of the said plate 13 and comprising vertical notches 61 which form stirrups which are open at the bottom and whose width corresponds to the diameter of the connecting rod 50. In front of each notch 61, the fixing web 59 includes a reduction 62 of a depth equalling the thickness of the retaining head 53 which is therefore inside or at the most level with the front face of the fixing web 59. FIG. 4 shows very clearly that the upper notches 61 of the lateral webs 59 are laterally offset so as to be accessible from the bottom, this offsetting corresponding to the median width of the web 59.

Very obviously, to position or remove an interior plate 13, the control chambers 56 of the four locking actuators 45, 46 are simply supplied with pressurized fluid so as to space the retaining heads 53 from the support frame 1, i.e., to push them slightly forward, these retaining heads 53, without the action of this control fluid, being applied under the action of return springs 55 against the reduced part 62 of the interior plate 13, which surrounds the notches 61, of the web 59. When the retaining heads 53 are in disengaged position, the interior wall 13 can be removed, or, when remounted, can cover and rest via the notches 61 on the connecting rods 50.

The ingot mold with plates has for each wall 12, 13 at least two sliding rapid couplings 21 capable of connecting the cooling circuit of each wall 12, 13 to the supply passage 8 and to the discharge passage 9 of the support frame 1. Each of these rapid couplings 21 has a horizontal sliding member 63 preferably passing through the median lower or upper part of one of the beams 4 to 7 of the support frame 1 sealingly, the axis of the said sliding member 63 being perpendicular to the rear vertical faces (32, 48) of a beam 4 to 7. The sliding member 63 passes through the beam 4, 5, 6 or 7 at the level of the supply passage 8 or the discharge passage 9 so as to pass beyond the lateral vertical faces of the beam 4, 5, 6 or 7 concerned on both sides. This sliding member 63 is constituted by a tube inside which a transverse partition 64 delimits two chambers, each opening at one end of the tube:

a front chamber which can connect by radial bores 65 with the supply or discharge passage 8 or 9, and whose front end bears sealingly against a gasket 66 of the plate 12 or 13 and opens into the inlet or outlet orifice 23 or 24 of the cooling circuit of the wall 12 or 13 concerned, and a rear chamber which forms part of a control actuator, the rear end of the tube 63 forming outside the beam 4, 5, 6 or 7 an annular piston 67 which slides sealingly in a cylinder 68 which is fixed sealingly on the rear face 32, 48 of the beam and which constitutes with the said annular piston a control actuator for the rapid coupling 21. A return spring 69 goes into the rear chamber of the sliding member 63 and bears against the transverse partition 64, on the one hand, and the bottom of the cylinder 68, on the other, so as to urge the member 63 permanently in the direction of the support frame. The annular chamber 70 delimited between the cylinder 68, the front face of the piston 67 and the sliding tubular member 63 is coupled to a source of pressurized fluid by means of a conduit 71 and a valve (not shown).

Thus, the withdrawal of the tubular conduit 63 is controlled by supplying the chamber 70, the front end of the conduit coming away from the orifice 23 (24) of the wall 12 (13) and moving aside into the support frame 1. Simultaneously, the bores 65 are shut off and communication between the tubular conduit 63 and the supply or discharge passage is cut off. When supply to the chamber 70 is cut off, the spring 69 pushes back the tubular conduit 63 until its front end is applied against the orifice of the wall and the bores 65 assures communication with the passage 8 or 9.

The control chambers 35 of the thrust actuators 27, 28, 29, 30, 56 of the application actuators 45, 46 and 70 of the actuators 67, 68 for controlling the rapid couplings are connected to the same pressurized fluid source so that they can be supplied or cut off simultaneously.

Thus, when the control chambers 35, 56 and 70 are supplied, the fixing studs 37 and the rapid couplings 63 are moves aside into the support frame and the retaining heads 53 move forward into the passage cavity 17. The longitudinal and transverse walls 12 and 13, previously prepared in the workshop, can thus be put into position inside the support frame easily and rapidly.

Supply to the control chambers 35, 56 and 70 of the actuators is then cut off and the return springs assure automatically and simultaneously positioning of the rapid couplings and the opening of the cooling circuits, engagement of the fixing studs 37 in the recesses 25 of the longitudinal walls 12, application of these against the transverse walls 13 and application of the latter against the support frame 1.

FIG. 1 shows clearly that the inner faces of the exterior longitudinal walls 12 bear at each end on the lateral faces 60 bounding the active part 58 of each transverse or interior wall 13 so that the separation $l_1$ of the two lateral faces 60 determines the separation of the inner faces of the longitudinal walls 12 and consequently the thickness of the cast slab.

In addition, it is the thickness $e_2$ of the interior walls 13 applied against the interior faces 87 of the sides 5, 7 of the support frame 1 which determines the separation $l_2$ between the inner faces 16 of the said walls 13 and consequently the width of the cast slab.

The thickness $e_1$ of the longitudinal walls 12 is slightly less than the separation between the inner faces 14 applied against the faces 60 and the interior faces 86 of the corresponding sides 4, 6 of the support frame 1, so that there is a clearance a between the wall 12 and the support frame 1 just sufficient to allow easy positioning of the wall 13, and so that the rods 34 of the thrust actuators 18 need only stand away from the interior face 86 of the support frame 1 by this small distance.

The respective thicknesses $e_1$ and $e_2$ of the longitudinal walls 12 and the transverse walls 13 therefore need to be easily adjusted. To achieve this, each wall 12 or 13 is advantageously constituted by several elemental plates 72, 73, 74 and 75 (see FIG. 6), i.e., a first interior plate 72 made of copper delimiting one of the sides of the passage cavity 17, a metal distribution plate 73 comprising a lower supply chamber 76 and an upper collecting chamber 77, an intercalated elemental plate 74 and a supporting plate 75 made of steel.

In the case of the transverse walls 13, the plates 72, 73 and 74 have a width equal to the previously defined distance $l_1$, so that their ends form the lateral faces 60 on which the longitudinal walls 12 bear. On the other hand, the supporting plate 75 is wider so that it extends laterally beyond the other elemental plates on both sides of the said lateral faces 60, so as to form the two lateral webs 59 on which the notches 61 forming the fixing stirrups of the wall are provided.

The thickness of a wall 12, 13 can thus be altered by the use of several intercalated elemental plates 74 or by intercalated plates 74 of different thicknesses. The elemental supporting plate 75, the intercalated elemental plates 74 and the elemental distribution plate 73 each have passage openings 78 which are aligned and delimit either the inlet orifice 23 opening into the supply chamber 76 or the outlet orifice 24 opening into the collecting chamber 77. Seals 79 are disposed about the passage openings 78 and between two adjacent elemental plates, for example 74, 75. On its rear face, near the edge, the copper plate 72 has a sealing rib 80 which sinks partially into a seal 81 provided on the front face of the elemental distribution plate 73. The copper plate 72 is fixed on one of the other elemental plates, for example 73, by means of screw 82 whose end is sunk in the copper plate 72 and whose head is sunk in a suitable recess in the corresponding rear plate such as 73. The copper plate 72 and the distribution plate 73 are separated from each other by a certain distance determined by the sealing rib 80 and delimit together with this a cooling chamber 83 connected at the bottom to the supply chamber 76 by a series of supply passages 84 and at the top to the collecting chamber 77 by a series of collecting passages 85.

I claim:

1. In an ingot mold with adjustable dimensions for a continuous casting machine, comprising a support frame, means for fixing said support frame onto an oscillation table, a rectangular casting cavity having a thickness and a width inside said support frame, said casting cavity being defined by the inner faces of two longitudinal walls and two parallel transverse walls in opposed relation at the sides of said support frame, said transverse walls being interposed between said longitudinal walls and determining the thickness ($l_1$) of said casting cavity; means for applying said longitudinal walls against said transverse walls, supported against corresponding sides of said support frame, removable means for fixing said transverse walls on the other two sides of said support frame, and means for adjusting the spacing of opposed inner faces of said transverse walls and thereby the width ($l_2$) of said casting cavity, each said transverse wall having an individual cooling circuit and removable means for sealed coupling to a cooling fluid supply circuit and to a discharge circuit in said support frame, the improvement wherein (a) said means for fixing said transverse walls are constituted by actuators for applying each said transverse wall against an interior face of the corresponding side of said support frame, each said transverse wall extending over a thickness equal to the distance between said interior face of said support frame and the inner face of said casting cavity;

(b) removable means are provided for coupling with corresponding coupling members urged outward from said support frame by said actuators so as to fix a said transverse wall, and inward so as to free said transverse wall; and (c) said means for adjusting the spacing of said opposed inner faces of said transverse walls are constituted by at least one element for adjusting the thickness of at least one of said transverse walls.

2. The improvement according to claim 1, wherein each of said longitudinal walls extends over a thickness between the inner face facing towards said casting cavity and an outer face facing towards the interior face of the corresponding side of said support frame and only separated from this by a clearance sufficient for positioning of said longitudinal wall, said means for applying the longitudinal walls bearing against said support frame having removable members for fixing said longitudinal walls and being separated from the interior faces of said support frame by a distance which only equals said clearance, each of said longitudinal walls being provided with at least one member for adjusting its thickness as a function of the thickness of said casting cavity determined by the width of said transverse walls.

3. The improvement according to claim 2, wherein said transverse and longitudinal walls are removable and said support frame is rigidly and permanently fixed on said oscillation table, the dimensions of said casting cavity being determined by adjustment of the thickness of said transverse and longitudinal walls.

4. The improvement according to any one of the preceding claims, wherein each of said longitudinal and transverse walls is constituted by an assembly of a plurality of elemental plates, a copper plate bounding said casting cavity and fixed on a support plate, a distribution and fixing plate facing said support frame, and at least one intercalated plate interposed between said support plate and said distribution plate and constituting the member for adjusting the thickness of each of said assemblies of plates.

5. The improvement according to claim 4, wherein the cooling circuit of each said longitudinal and transverse wall includes, inside said distribution and fixing plate, a supply chamber and a collecting chamber connected to a cooling chamber provided between said copper plate and said support plate by passages through said intercalated plate and respectively provided with an inlet orifice and an outlet orifice for the cooling fluid.

6. The improvement according to claim 5, wherein, as the circuit for supplying and the circuit for discharging the cooling fluid are constituted by two parallel passages for circulation of the fluid provided along the sides of said support frame, the removable means for coupling said cooling circuit of each said longitudinal and transverse wall sealingly with said circuits are constituted, opposite each inlet or outlet orifice, by a rapid coupling comprising a tubular conduit mounted to slide through a corresponding passage whose rear end is formed by a partition and forms a piston sliding in an actuator body solid with said support frame, and whose front end passes through the interior face of said support frame, said partition bounding at the front a front chamber opening opposite the corresponding orifice of said respective longitudinal or transverse wall, said tubular conduit being provided with bores for placing said front chamber in communication with said passage for circulation of the fluid, said tubular conduit, depending on the direction of action exerted by said actuator on said piston, being alternately advanced towards the respective longitudinal or transverse wall determining the application of said front end of said tubular conduit to said orifice of said respective longitudinal or transverse wall and withdrawn into said support frame, said bores communicating with the circulation passage in the advanced position and being shut off in the withdrawn position.

7. The improvement according to claim 1, wherein said means for fixing said transverse walls comprise at least two actuators having rods each provided at their ends with a retaining head of enlarged section capable of being applied from inside to the corresponding coupling parts provided on each said wall and constituted by stirrups solid with said transverse wall, open at the bottom and each capable, on positioning of said transverse wall, of covering the corresponding actuator rod, between the interior face of said support frame and said retaining head.

8. The improvement according to claim 1, wherein said means for applying said longitudinal walls to said transverse walls comprise at least two actuators for each longitudinal wall, supported by the corresponding side of said support frame and having rods mounted to slide on said support frame transversely to the opposite wall and each provided at their free end with a support stud capable of engaging in a corresponding facing recess on the outer face of said longitudinal wall, said studs and said recesses constituting the removable fixing means for said longitudinal wall.

9. The improvement according to claim 6, wherein said actuators for applying, respectively, said rapid couplings to said cooling circuit orifices, said transverse walls to said support frame and said longitudinal walls to said transverse walls are each positively actuated by a spring in the direction of application and by hydraulic pressure in the opposite direction.

* * * * *

UNITED STATES PATENT AND TRADEMARK OFFICE

CERTIFICATE OF CORRECTION

PATENT NO. : 4,506,724

DATED : March 26, 1985

INVENTOR(S) : Raymond Vial

It is certified that error appears in the above-identified patent and that said Letters Patent is hereby corrected as shown below:

On the title page assignee should read

--(73)Assignee: Clesid S.A., Saint-Chamond, France --.

Signed and Sealed this

Fifth Day of July, 1988

*Attest:*

*Attesting Officer*

DONALD J. QUIGG

*Commissioner of Patents and Trademarks*